US005552672A

United States Patent [19]

Rosenberg

[11] Patent Number: 5,552,672

[45] Date of Patent: Sep. 3, 1996

[54] MAGNETRON CONSTRUCTION PARTICULARLY USEFUL AS A RELATIVISTIC MAGNETRON

[75] Inventor: Avner Rosenberg, Beit Shaarim, Israel

[73] Assignee: State of Israel Ministry of Defense, Armament Development Authority, Rafael, Haifa, Israel

[21] Appl. No.: 300,734

[22] Filed: Sep. 2, 1994

[30] Foreign Application Priority Data

Sep. 3, 1993 [IL] Israel ..... 106905

[51] Int. Cl.[6] ..... H01J 25/50; H01J 23/05

[52] U.S. Cl. ..... 315/39.51; 315/39.53; 315/39.63; 315/39.67

[58] Field of Search ..... 315/39.51, 39.53, 315/39.63, 39.67; 331/86

[56] References Cited

U.S. PATENT DOCUMENTS

| | | | |
|---|---|---|---|
| 2,513,933 | 7/1950 | Gurewitsch | 315/39.63 X |
| 3,109,123 | 10/1963 | Spencer | 315/39.63 |
| 3,306,753 | 2/1967 | White | 315/39.63 |
| 4,636,749 | 1/1987 | Thornber | 315/39.61 X |
| 5,010,468 | 4/1991 | Nilssen | 363/37 |
| 5,159,241 | 10/1992 | Kato et al. | 315/39.51 |

FOREIGN PATENT DOCUMENTS 2274941 8/1994 United Kingdom .

*Primary Examiner*—Benny T. Lee
*Attorney, Agent, or Firm*—Helfgott & Karas, P.C.

[57] ABSTRACT

A magnetron includes a cathode and an anode in a vacuum chamber radially spaced from each other to define an interaction region in which a magnetic field is produced parallel to the interaction region. The anode is supplied with positive high-voltage pulses while the cathode and vacuum chamber are at a reference (ground) potential. The anode is of annular configuration located coaxially around the cathode and is formed with cavities facing the cathode, in the form of a rod, and is formed with cavities facing the cathode to define an annular interaction region between the anode and cathode.

19 Claims, 3 Drawing Sheets

MAGNETRON CONSTRUCTION PARTICULARLY USEFUL AS A RELATIVISTIC MAGNETRON

FIELD AND BACKGROUND OF THE INVENTION

The present invention relates to magnetrons for generating high-frequency microwave radiation. The invention is particularly useful in relativistic magnetrons, and is therefore described below particularly with respect to this application.

The relativistic magnetron is one of the most successful classes of high power microwave generators in present use, i.e., generators which are capable of generating electromagnetic power pulses above about 100 megawatts and up to tens of gigawatts. Typical pulse lengths are between a few tens of nanoseconds and a few microseconds.

The relativistic magnetrons produce high power levels with good efficiency and frequency stability. They are basically very similar to the conventional magnetrons developed during World War II.

Both the conventional magnetron and relativistic magnetron include a cathode and an anode in a vacuum chamber radially spaced from each other to define an interaction region, means for producing an electric field E between the anode and cathode, and means for producing a magnetic field B perpendicular to the electric field E. Electrons emitted from the cathode are accelerated by the electric field E towards the anode in the presence of the magnetic field B perpendicular to the electric field to produce the well known E×B drift velocity. Within the anode, a set of identical cavities create a slow wave structure. When the phase velocity of the electromagnetic wave rotating in the interaction region equals the E×B drift velocity of the electrons, energy is transferred from the electrons to the electromagnetic wave.

The relativistic magnetron differs from the conventional magnetron in the following two basic ways:

(a) The driving voltages and currents in the relativistic magnetron are at least an order of magnitude larger than in the conventional magnetron; thus, the name "relativistic" indicates that at these voltages the electrons gain kinetic energy comparable to the rest mass of the electron (511 KeV).

(b) In the conventional magnetron, the electrons are emitted from a hot cathode. The relativistic magnetron, however, exploits the .extremely high electric field to emit electrons from a cold cathode. The mechanism of action of the cathode is quite complicated and is sometimes known as "explosive emission". Very large current densities are produced, which enable the generation of very high power microwaves.

Since relativistic magnetrons are driven by pulses of several hundred kV, any curved surface at the cathode potential tends to emit electrons and/or to initiate a high-voltage breakdown. In addition, special problems are involved in providing the required high level magnetic field (in the order of a few kGauss), which is a major problem in reducing the size, weight and cost of the relativistic magnetron. Further, a well know problem of relativistic magnetrons of the conventional design is the "axial current", resulting from the drift along the magnetic field lines of electrons emitted from the cathode and leaving the interaction region. These electrons do not contribute to the generation of the microwaves; their energy is lost to heat, and the efficiency of the magnetron is thereby reduced.

OBJECTS AND BRIEF SUMMARY OF THE INVENTION

An object of the present invention is to provide a novel magnetron construction which provides a number of advantages in the above respects particuarly when embodied in a relativistic magnetron.

According to the present invention, there is provided a magnetron including a cathode and an anode in a vacuum chamber radially spaced from each other to define an interaction region therebetween, and means for producing a magnetic field in the interaction region; characterized in that the magnetron includes means for supplying the anode with positive high-voltage pulses, of at least 100 kV while the cathode and vacuum chamber are at a reference potential.

According to further features in the preferred embodiments of the invention described below, the cathode and vacuum chamber are at ground potential; in addition, the cathode is a cold cathode in the form of a rod, and the anode is of annular configuration located coaxially surrounding the cathode and includes cavities facing the cathode to define a reaction region as an annular interaction region between the anode and cathode. In addition, the cathode includes a field enhancement structure. In the described embodiment, the latter structure is in the form of a disc fixed to the cathode rod and having sharpened outer edges facing the annular interaction region, for enhancing the electron emission from a small annular surface of the cathode rod into the annular interaction region; however, other field enhancement structures may be used.

A magnetron constructed in accordance with the foregoing features provides a number of advantages, which are particularly important in relativistic magnetrons, over the conventional magnetron construction wherein negative high-voltage pulses are applied to the inner electrode (i.e., the cathode), and the outer electrode (i.e., the anode) and the housing are at substantially ground potential.

One important advantage is derived from the fact that positive electrodes do not emit electrons. Thus, the application of the positive high-voltage pulse to the anode while maintaining the outer housing at substantially ground potential, enables the external parts to be made with radii of curvature much larger than the positive inner parts (anode and its voltage feed) with a substantial reduction in undesired electronic emission and also in the risk of high-voltage breakdown. The field enhancement structure of the cathode (e.g., the disc fixed to the cathode rod and formed with sharpened outer edges) ensures electronic emission at the desired location.

A further important advantage is that the reduced risk of electronic emission and high-voltage breakdown enables magetrons, and particularly relativistic magnetrons, to be constructed with reduced inter-electrode spacings, and therefore of reduced size and weight.

A still further advantage is that, since the magnetron is driven by positive high-voltage pulses applied to the anode, the high-voltage feed does not have to be coaxial with the anode-cathode structure (parallel to the magnetic field), and can be connected to the outside of the anode, perpendicularly to the applied magnetic field. This makes possible the use of permanent U-shaped magnets or electromagnets with U-shaped ferromagnetic cores, which enables significant reduction in the size, weight and cost of the magnetron.

Yet another advantage, particularly in relativistic magnetrons, is that the electron emitting region on the cathode may be located symmetrically within the anode so that the component of the electric field parallel to the magnetic field is reduced. This reduces the electron drift in this direction, thereby reducing the "axial current" problem mentioned earlier. Moreover, since the external housing is at ground potential, electrons are reflected by the housing towards the interaction region, thereby further reducing the axial current.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
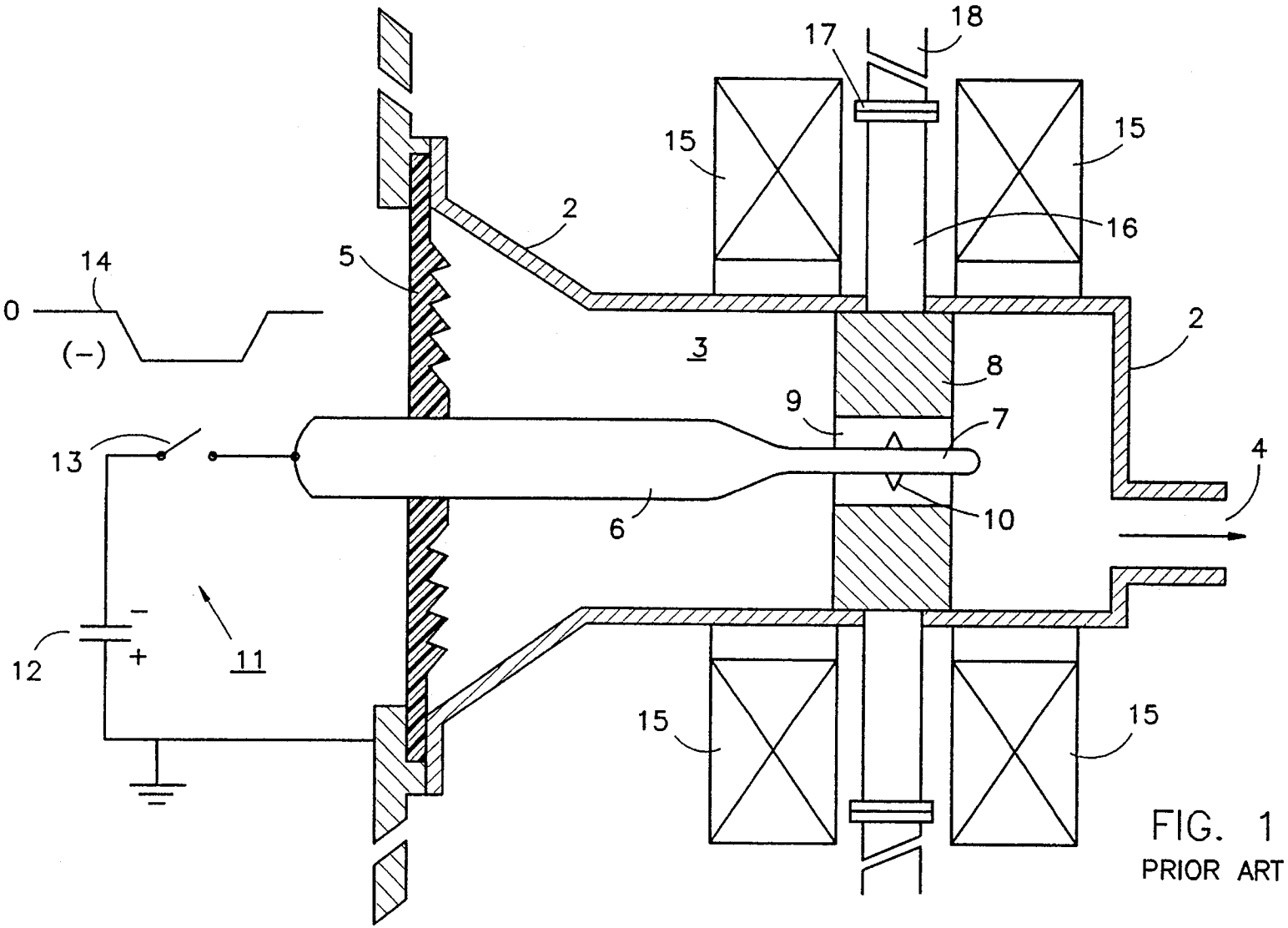
FIG. 1 PRIOR ART
FIG. 1 schematically illustrates a relativistic magnetron known in the prior art.

Reference is first made to FIG. 1 illustrating a prior art construction of a relativistic magnetron. It includes a housing 2 defining an internal vacuum chamber 3 formed with a vacuum port 4 connected to a vacuum source for maintaining chamber 3 under a high vacuum (about $10^{-6}$ Torr). Housing 2 is closed by a high-voltage dielectric insulator 5 which is penetrated by the shank 6 of a cathode rod 7 located within the vacuum chamber. Also located within the vacuum chamber is an annular anode 8 coaxial around the cathode 7. The inner face of anode 8 is formed with a plurality of cavities (not shown) facing the cathode and spaced therefrom to define an annular interaction region 9 between the anode and cathode. The cathode 7 includes a field enhancement structure, in the form of disc 10 fixed thereto and formed with sharpened outer edges, for enhancing electronic emission from a small annular surface of the cathode into the annular interaction region 9.

In the prior art relativistic magnetron of FIG. 1, negative high-voltage pulses are applied to the cathode shank 6 via a high-voltage pulsed power generator 11. Generator 11 includes an energy storage capacitor 12 (or a pulse-forming network) having the positive side (+) grounded to the housing 2, and the negative side (−) connected to a fast-operated switch 13 for applying negative high-voltage pulses (as shown by negative pulse 14 in FIG. 1) to the cathode 7. Helmholz coils 15 create the axial magnetic field. The high-frequency energy generated by the relativistic magnetron is outputted via an output port 16, a vacuum window 17 and a waveguide 18.

As described earlier, such a prior art construction requires surfaces of large radii of curvature in order to reduce undesired electron emissions and also to reduce the risk of high-voltage breakdown. In addition, large and bulky Helmholz coils are generally required to produce the needed high intensity magnetic field. Further, the "axial current" produced by such a magnetron reduces its efficiency.

Figure 2:
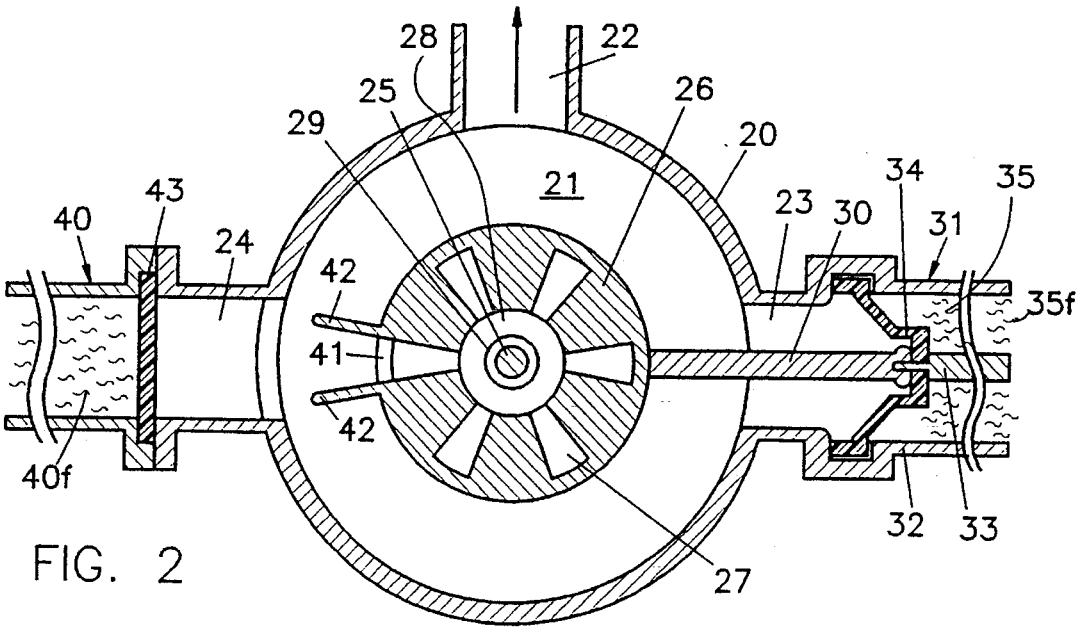
FIG. 2 is a transverse sectional view illustrating one form of relativistic magnetron constructed in accordance with the present invention.
Figure 3:
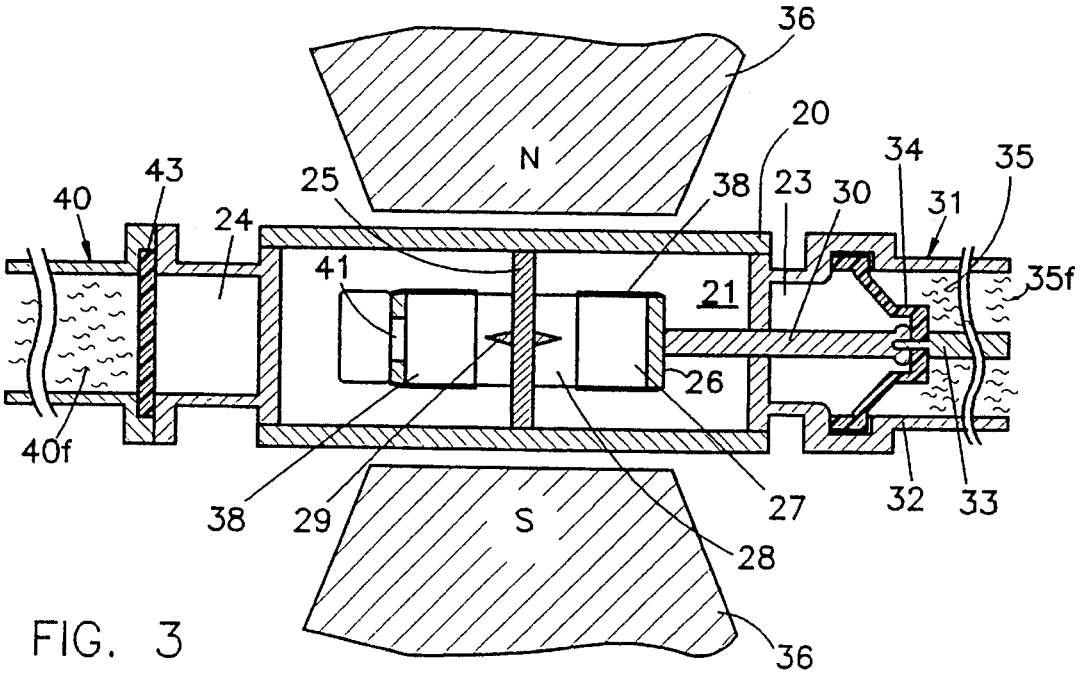
FIG. 3 is a longitudinal sectional view of the relativistic magnetron of FIG. 2.

The foregoing drawbacks in the prior art construction of relativistic magnetrons are avoided, or significantly reduced, by the relativistic magnetron structure illustrated in FIGS. 2 and 3. A main feature of this novel construction is that, instead of supplying the cathode with negative high-voltage pulses as in the prior art construction, the anode in the novel construction illustrated in FIGS. 2 and 3 is supplied with positive high-voltage pulses, while the cathode and the vacuum chamber are maintained at a reference potential, e.g., ground.

Thus, the relativistic magnetron illustrated in FIGS. 2 and 3 includes a metal housing 20 defining an internal vacuum chamber 21. Housing 20 is formed with three ports: a vacuum port 22 (FIG. 2) connectible to a vacuum source for maintaining a high vacuum (e.g., about $10^{-6}$ Torr); a high-voltage input port 23 for applying the positive high-voltage pulses to the anode within the vacuum chamber 21; and an output port 24 for outputting the high-frequency energy generated by the magnetron.

Disposed within vacuum chamber 21 are an inner cathode rod 25 and an outer annular anode 26 coaxial with the cathode rod. Anode 26 is formed with a plurality of cavities 27 facing cathode rod 25 and spaced therefrom to define an annular interaction region 28. Cathode rod 25 further includes a field enhancement structure in the form of a disc 29 fixed centrally of the cathode rod and having a sharpened outer edge facing the annular interaction region 28 for enhancing electron emission from a small annular surface of the cathode rod into that region.

The positive high-voltage pulses are applied to the anode 26 by means of an electrically-conductive anode rod 30 passing through the injection port 23. The positive pulses are applied to anode rod 30 via an input coupler 31. This coupler includes an outer electrical conductor 32 connected to housing 20, an inner electrical conductor 33 connected to the anode rod 30, and an insulator 34 sealing the interior of housing 20 and insulating the anode rod 30 from the outer conductor 32 and from the housing 20. The space 35 of the input coupler 32 between the outer and inner conductors 32, 33 is preferably filled with a pressurized insulating fluid **35*f***, such as $SF_6$, namely sulfur hexafluoride, a gas at room temperatures having excellent high-voltage insulating properties.

The magnetic field for the magnetron is produced by a magnet 36, producing a magnetic field between its North pole (N) and its South pole (S) parallel to the cathode rod 25, as shown particularly in FIG. 3. Electrons emitted from disc 29 of the cathode rod 25 are rotated in the interaction region 28 by the E×B drift. When their angular velocity approximately equals the phase velocity of the electromagnetic wave between the anode cavities, energy is transferred from the electrons to the electromagnetic wave.

As shown in FIG. 3, the anode has end caps 38 which concentrate the microwaves within the anode block. However, these end caps are not essential for the magnetron operation.

The high-frequency energy so generated is outputted to a waveguide 40 coupled to the output port 24. For this purpose, the anode 26 is formed with a bore 41 aligned with the output port 24, diametrically opposite to the inlet port 22 and to the high-voltage anode rod 30. Anode 26 further includes a pair of diverging extensions 42 for directing the high-frequency energy from the output bore 41 and the output port 24 to the output waveguide 40. The output port 24 is closed by a window 43 which is transparent to the generated high-frequency energy. Output waveguide 40 may also be filled with a pressurized insulating fluid, 40*f* such as $SF_6$.

It will be seen that in the relativistic magnetron illustrated in FIGS. 2 and 3, the energizing of the magnetron by positive high-voltage pulses applied to the anode 26, while maintaining the cathode 25 and the housing 20 at ground potential, avoids or significantly reduces the many drawbacks of the prior art relativistic magnetron described earlier.

Figure 4:
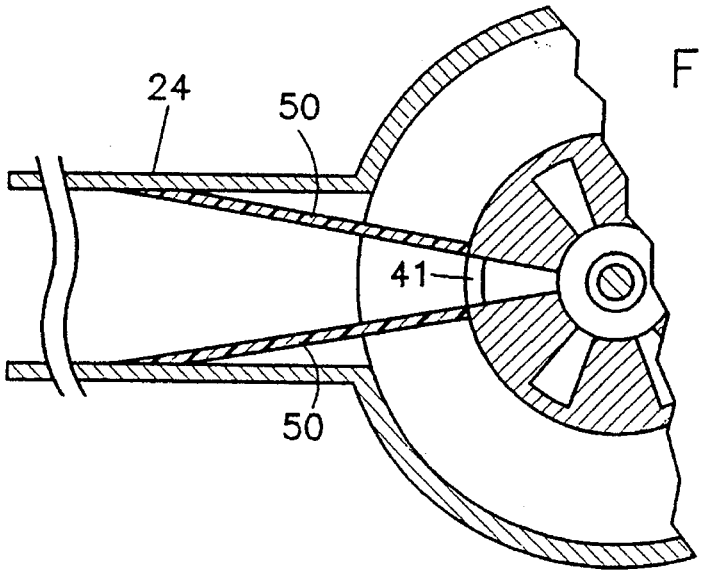
FIG. 4 is a fragmentary view illustrating a modification in the relativistic magnetron of FIGS. 2 and 3.

FIG. 4 illustrates a modification in the construction of the relativistic magnetron of FIGS. 2 and 3. Instead of providing diverging anode extensions (42) straddling the output bore 41 of the anode 26, for directing the high-frequency energy to the output waveguide 40 (e.g., see FIGS. 2 and 3), there are provided diverging dielectric members 50 for this purpose. These dielectric members 50 extend from the outlet bore 41 of the anode into the output waveguide port 24 to direct the high-frequency energy to the output waveguide.

Figure 5:
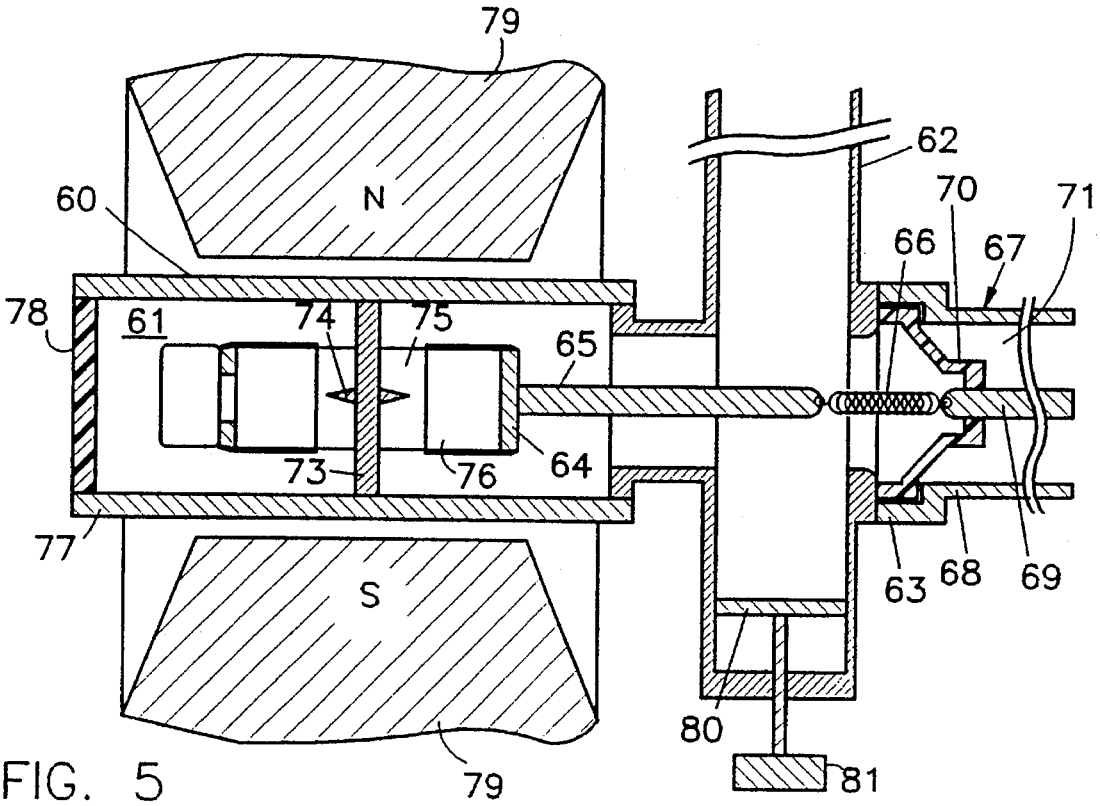
FIG. 5 is a longitudinal sectional view illustrating another form of relativistic magnetron constructed in accordance with the present invention.

FIG. 5 illustrates another construction of relativistic magnetron in accordance with the present invention. In this construction, the housing 60 defining the internal vacuum chamber 61 does not have a separate waveguide output port as in FIGS. 2–4; rather, the high-frequency electromagnetic wave generated by the magnetron is coupled to an output waveguide 62 via the input port 63 through which the positive high-voltage pulses are applied to the anode 64. Thus, the anode 64, and the anode rod 65 passing through the input port 63 for applying the positive high-voltage pulses to the anode, create an antenna inside the vacuum chamber 61 which collects the microwaves into the coaxial input port 63. From this point, one can apply standard techniques of coaxial-to-waveguide transitions for coupling the output to the waveguide 62.

Thus, as shown in FIG. 5, the coaxial input port 63 is physically connected to the output waveguide 62. The anode rod 65 is received within an opening in the waveguide 62 and radiates into it. The positive high-voltage pulses are applied to the anode rod 65 through an inductance coil 66. The inductance of this coil is so chosen to provide a low impedance path for the high-voltage pulse applied to the anode 64 via the anode rod 65, and a high impedance for the microwave frequencies generated within the magnetron.

The magnetron illustrated in FIG. 5 includes a coaxial-type input coupler 67, having an outer conductor 68 electrically connected to the waveguide 62 and to the housing 60 of the magnetron (which is grounded) and an inner conductor 69 connected to the anode 64 via the anode rod 65 and the previously-mentioned inductance coil 66. The interior of housing 60 and of the waveguide 62 is sealed by an insulator 70 through which the inner conductor 69 passes. The anode 64 may be supported in any suitable manner, e.g., by delectric rods (not shown) fixed to the external housing 60. The input coupler 67 may also include a pressurized insulating fluid in the space 71 between the inner and outer conductors 68 and 69.

As in the previously-described embodiments, the cathode 73 is in the form of a rod including a disc 74 having a sharpened outer edge facing the annular interaction region 75 for enhancing the electron emission from a small annular surface of the cathode into the annular interaction region. As also in the previously-described embodiments, the anode 64 is located coaxially around the cathode 73 and is formed with cavities 76 facing the cathode to define the annular interaction region 75.

In this construction, housing 60 may be of substantially cylindrical configuration open at its opposite ends. One end serves as the previously described high-voltage input port 63 for applying the positive high-voltage pulses to the anode 64, and its opposite end serves as a vacuum port 77 connectible to a source of vacuum for maintaining a high vacuum within the interior of the housing. The vacuum port 77 may be closed by an insulator 78. The housing 60 and the cathode rod 73 electrically connected to it are grounded so that, as in the previously-described embodiments, the "hot" electrode is the anode 64 which receives the positive high-voltage pulses. The magnetic field is produced by magnet 79 externally of housing 60 to extend parallel to the annular interactive region 75 between the cathode 73 and the anode 64.

The output waveguide 68 is coupled to the magnetron via the input port 63 in the manner described above. It may be adjusted to provide maximum coupling by means of a reflector 80 having a manually-adjustable knob 81 projecting externally of the waveguide.

While the invention has been described with respect to several preferred embodiments, it will be appreciated that these are set forth merely for purposes of example, and that many other variations, modifications and applications of the invention may be made.

What is claimed is:

1. A relativistic magnetron including a cathode and an anode in a vacuum chamber radially spaced from each other to define an interaction region therebetween, and means for producing a magnetic field in said interaction region; characterized in that said magnetron includes means for supplying the anode with positive high-voltage pulses of at least 100 kV, while maintaining said cathode and vacuum chamber at a reference potential.

2. The magnetron according to claim 1, wherein said cathode is a cold cathode in the form of a rod, and said anode is of annular configuration coaxially surrounding said cathode and includes cavities facing said cathode to define said interaction region as an annular interaction region between said anode and cathodes.

3. The magnetron according to claim 2, wherein said anode cavities include end caps.

4. The magnetron according to claim 2, wherein said cathode includes a field enhancement structure for enhancing electron emission from a small annular surface thereof into said annular interaction region.

5. The magnetron according to claim 4, wherein said field enhancement structure is a disc fixed to said cathode rod and having sharpened outer edges facing said annular interaction region.

6. The magnetron according to claim 1, wherein said vacuum chamber is defined by a housing which includes a vacuum port for supplying vacuum in said vacuum chamber, and a high-voltage input port; said magnetron further including an electrically-conductive anode rod passing through said high-voltage input port and connected to said anode, and an input coupler coupled to said electrically-conductive rod for applying high-voltage pulses to said anode.

7. The magnetron according to claim 6, wherein said input coupler includes an outer electrical conductor electrically connected to said housing, an inner electrical conductor electrically connected to said anode rod, and an insulating seal sealing said housing and insulating said anode rod from said outer electrical conductor.

8. The magnetron according to claim 7, wherein said input coupler further includes a pressurized insulating fluid.

9. The magnetron according to claim 6, wherein said anode further includes an output bore through one of said cavities for outputting high-frequency energy generated thereby, an output port aligned with said bore, and an output waveguide coupled to said output port.

10. The magnetron according to claim 9, wherein said output port is sealed by a window transparent to the high-frequency energy generated by the magnetron.

11. The magnetron according to claim 10, wherein said output waveguide further includes a pressurized insulating fluid.

12. The magnetron according to claim 9, further including diverging anode extensions straddling said anode output bore for directing the high-frequency energy to said output waveguide.

13. The magnetron according to claim 9, further including diverging dielectric members straddling said anode output bore for directing the high-frequency energy generated by the magnetron to said output waveguide.

14. The magnetron according to claim 6, further including an output waveguide connected to said high-voltage input port; said input coupler being coupled to said electrically-conductive anode rod by a coupling which produces a low impedance path for the high-voltage pulses applied thereto, and a high impedance path for the high-frequency energy generated by the magnetron.

15. The magnetron according to claim 14, wherein said output waveguide extends perpendicularly to a longitudinal axis of said electrically-conductive anode rod.

16. The magnetron according to claim 15, wherein said output waveguide includes an adjustable reflector for varying the coupling with respect to the high-frequency energy generated by the magnetron.

17. The magnetron according to claim 1, wherein said reference potential is ground potential.

18. A magnetron comprising:

a metal housing defining an internal vacuum chamber including at least one output port therewith;

a cathode rod electrically connected to said metal housing and having an electron emitting area in said vacuum chamber;

an annular anode in said vacuum chamber radially spaced from said cathode rod to define an annular interaction region therebetween;

means for producing a magnetic field parallel to said cathode rod;

means for supplying said anode with positive high-voltage pulses while maintaining said cathode and vacuum chamber at a reference potential to produce high-frequency electromagnetic energy in said interaction region;

and means for outputting said high frequency electromagnetic energy via said at least one output port, wherein said means for supplying said anode with positive high-voltage pulses supplies said anode with pulses of at least 100 kV.

19. A magnetron, comprising:

a metal housing defining an internal vacuum chamber including at least one output port therewith;

a cathode rod electrically connected to said metal housing and having an electron emitting area in said vacuum chamber;

an annular anode in said vacuum chamber radially spaced from said cathode rod to define an annular interaction region therebetween;

means for producing a magnetic field parallel to said cathode rod;

means for supplying said anode with positive high-voltage pulses while maintaining said cathode and vacuum chamber at a reference potential to produce high-frequency electromagnetic energy in said interaction region;

and means for outputting said high frequency electromagnetic energy via said at least one output port, wherein said means for supplying said anode with positive high-voltage pulses comprises a metal rod connecting the anode to a positive pulse source and extending perpendicular to said cathode rod.

* * * * *